US011673717B2

(12) United States Patent
Ni

(10) Patent No.: US 11,673,717 B2
(45) Date of Patent: Jun. 13, 2023

(54) BEVERAGE CONTAINER WITH PUSH SEALING ARRANGEMENT

(71) Applicant: Ozean International Inc, San Marino, CA (US)

(72) Inventor: Zhenming Ni, San Marino, CA (US)

(73) Assignee: Ozean International Inc., San Marino, CA (US)

( * ) Notice: Subject to any disclaimer, the term of this patent is extended or adjusted under 35 U.S.C. 154(b) by 16 days.

(21) Appl. No.: 17/504,355

(22) Filed: Oct. 18, 2021

(65) Prior Publication Data

US 2023/0063031 A1 Mar. 2, 2023

(30) Foreign Application Priority Data

Aug. 27, 2021 (CN) ..... 202122039039.2

(51) Int. Cl.
*B65D 43/02* (2006.01)
*A47G 19/22* (2006.01)
*B65D 51/18* (2006.01)

(52) U.S. Cl.
CPC ..... *B65D 43/0227* (2013.01); *A47G 19/2272* (2013.01); *B65D 51/18* (2013.01); *B65D 2251/0028* (2013.01); *B65D 2251/0081* (2013.01); *B65D 2543/00046* (2013.01)

(58) Field of Classification Search
CPC ..... B65D 43/12; B65D 43/20; B65D 43/0227; B65D 43/0225; B65D 43/0216; B65D 51/18; B65D 39/16; B65D 2543/00046; A47G 19/2272;
USPC ..... 220/711, 715, 714, 713, 254.9, 254.1, 220/259.5, 256.1, 348, 345.4, 345.1, 812, 811, 220/810, 804, 801, 796
See application file for complete search history.

(56) References Cited

U.S. PATENT DOCUMENTS

2022/0348387 A1* 11/2022 Ni ..... A47G 19/2272

* cited by examiner

*Primary Examiner* — Robert J Hicks
(74) *Attorney, Agent, or Firm* — Tsz Lung Yeung

(57) ABSTRACT

A beverage container includes a container body, a lid having a support panel, and a push sealing arrangement. The push sealing arrangement includes a cover assembly, a main shaft and a sealing piece. The cover assembly includes a first cover. The sealing piece includes a second cover positioned underneath the first cover and the access opening. The cover assembly is arranged to move between an opened position and a closed position. In the closed position, the cover assembly is slid to drive the first cover to cover on top of the access opening, while the second cover is driven to move upwardly for blocking a bottom side of the access opening. In the opened position, the first cover is slid to expose the access opening to ambient environment, while the second cover is driven to move downwardly to allow liquid to flow out of the container body.

20 Claims, 10 Drawing Sheets

BEVERAGE CONTAINER WITH PUSH SEALING ARRANGEMENT

BACKGROUND OF THE PRESENT INVENTION

Field of Invention

The present invention relates a beverage container, and more particularly to a beverage container comprising a push sealing arrangement, in which a cover assembly and a sealing piece provides a double sealing effect to an access opening of a lid body so as to prevent liquid from spilling out of the beverage container even when it is flipped side way or turned upside down.

Description of Related Arts

A conventional container, such as a beverage container for containing water, usually comprises a container body and a lid detachably attached on the container body. The container body has a container cavity for storing a predetermined amount of fluid, such as water. The lid usually comprises a lid body having a drinking hole communicating with the container cavity, and a sealing handle movably mounted on the lid body for selectively opening or closing the drinking hole.

Conventionally, the sealing handle may be coupled to the lid body in such a manner that the sealing handle can rotate with respect to the lid body. Through rotational movement of the sealing handle, the sealing handle may be selectively rotate to open and block the drinking hole.

A major disadvantage of the conventional beverage container such as the one mentioned above is that there is no locking mechanism to restrict the rotational movement of the sealing handle. For those beverage containers which utilize similar structures, the sealing handle is tightly coupled to the lid body so that although the sealing handle may rotate with respect to the lid body, it is very hard for a user to rotate the sealing handle for opening and closing the drinking hole. This disadvantage presents great inconvenience to users especially when the beverage container is being used in outdoor environment or the users are very young (such as kids) when he or she does not have adequate power to turn the sealing handle.

Moreover, most conventional beverage containers having the sealing handle as mentioned above does not have adequate sealing so that when the beverage container is flipped side way or turned upside down, liquid in the beverage containers may spill out of the container.

Therefore, there is a need to develop a beverage container having a rotatable sealing handle which is easy to be rotated, which can be locked and unlocked with ease, and which has a superior sealing performance.

SUMMARY OF THE PRESENT INVENTION

Certain variations of the present invention provide a beverage container comprising a rotatable sealing arrangement, in which a cover assembly may be selectively rotated to selectively and securely seal a container cavity.

Certain variations of the present invention provide a beverage container comprising a rotatable sealing arrangement which prevents liquid from spilling out of the beverage container even when it is flipped side way or turned upside down.

Certain variations of the present invention provide a beverage container comprising a rotatable sealing arrangement which comprises a cover assembly and a sealing piece for providing double sealing effect to an access opening of a lid body. This effectively prevents liquid from spilling out of the beverage container even when it is flipped side way or turned upside down.

In one aspect of the present invention, it provides a beverage container, comprising:

a container body having a container cavity; and a lid, which comprises a lid body detachably attached on the container body to selectively enclose the container cavity, the lid body having a support panel, an actuation slot, and an access opening formed on the support panel; and a push sealing arrangement, which comprises:

a cover assembly which comprises a first cover movably mounted on the support panel, and a connector leg downwardly extended from the first cover to engage with the actuation slot;

a main shaft downwardly extended from the support panel; and a sealing piece movably coupled to the main shaft, the sealing piece comprising a second cover having a through hole and being positioned underneath the first cover and the access opening, the cover assembly being slid on the lid body to operatively move between an opened position and a closed position, wherein in the closed position, the cover assembly is slid to drive the first cover to cover on top of the access opening, while the second cover of the sealing piece is driven to move upwardly with respect to the main shaft for blocking a bottom side of the access opening so as to prevent liquid from the container cavity to spill out therefrom, wherein in the opened position, the first cover is slid to expose the access opening to ambient environment, while the second cover is driven to move downwardly with respect to the main shaft so as to allow liquid to flow out of the container cavity through the access opening.

In another aspect of the present invention, it provides a lid for a container body having a container cavity, the lid comprising:

a lid body detachably attached on the container body to selectively enclose the container cavity, the lid body having a support panel, an actuation slot, and an access opening formed on the support panel; and a push sealing arrangement, which comprises:

a cover assembly which comprises a first cover movably mounted on the support panel, and a connector leg downwardly extended from the first cover to engage with the actuation slot;

a main shaft downwardly extended from the support panel; and a sealing piece movably coupled to the main shaft, the sealing piece comprising a coupler ring having a through hole formed therein, a second cover sidewardly extended from the coupler ring to position underneath the first cover and the access opening, the cover assembly being slid on the lid body to operatively move between an opened position and a closed position, wherein in the closed position, the cover assembly is slid to drive the first cover to cover on top of the access opening, while the second cover of the sealing piece is driven to move upwardly with respect to the main shaft for blocking a bottom side of the access opening so as to prevent liquid from the container cavity to spill out therefrom, wherein in the opened position, the first cover is slid to expose the access opening to ambient environment, while the second cover is driven to move downwardly with respect to the main shaft so as to allow liquid to flow out of the container cavity through the access opening.

This summary presented above is provided merely to introduce certain concepts and not to identify any key or essential features of the claimed subject matter.

DETAILED DESCRIPTION OF THE PREFERRED EMBODIMENT

Figure 1A:
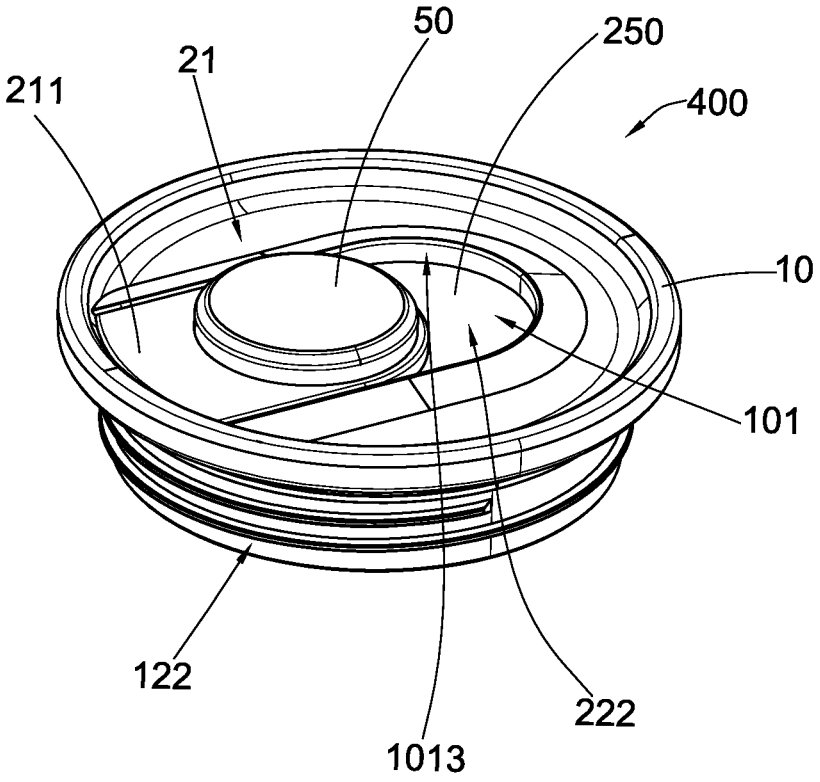
FIG. 1A is a top perspective view of a lid of a beverage container according to a preferred embodiment of the present invention.

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", "vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Referring to FIGS. 1 to 3, FIG. 4A to FIG. 4B and FIG. 5 to FIG. 7 of the drawings, a beverage container according to a preferred embodiment of the present invention is illustrated. The beverage container may comprise a container body 200, a lid 400, and a pushing sealing arrangement 300. The container body 200 may have a container cavity 111. The beverage container may be used for storing a predetermined amount of liquid, such as water, and may be carried in a portable manner.

The lid 400 may comprise a lid body 10 detachably attached on the container body 200 to selectively enclose the container cavity 111, the lid body 10 having a support panel 250, a plurality of (but at least one) actuation slots 110, and an access opening 113 formed on the support panel 250.

The push sealing arrangement 300 may comprise a cover assembly 21, a main shaft 13 and a sealing piece 22. The cover assembly 21 may comprise a first cover 211 movably mounted on the support panel 250, and a plurality of (but at least one) connector legs 212 downwardly extended from the first cover 211 to slidably engage with the actuation slots 110 respectively.

The main shaft 13 may downwardly extend from the support panel 250.

The sealing piece 22 may be movably coupled to the main shaft 13 and may comprise a second cover 221 having a through hole 220 and may be positioned underneath the first cover 211 and the access opening 113.

The cover assembly 21 may be slid on the lid body 10 to operatively move between an opened position and a closed position, wherein in the closed position, the cover assembly 21 is slid to drive the first cover 211 to cover on top of the access opening 113, while the second cover 221 of the sealing piece 22 may be driven to move upwardly with respect to the main shaft 13 for blocking a bottom side of the access opening 113 so as to prevent liquid from the container cavity 111 to spill out therefrom, wherein in the opened position, the first cover 211 may be slid to expose the access opening 113 to ambient environment, while the second cover 221 may be driven to move downwardly with respect to the main shaft 13 so as to allow liquid to flow out of the container cavity 111 through the access opening 113.

According to the preferred embodiment of the present invention, the container body 200 may be configured from metallic or plastic material and may have a circular cross-sectional shape. The container body 200 may form a tubular structure in which the container cavity 111 may be formed therein. The container body 200 may further have a top opening 201 communicating the container cavity 111 with an exterior of the container body 200. The lid 400 may be selectively attached on the container body 200 at the top opening 201 to selectively close the container cavity 111.

Figure 4A:
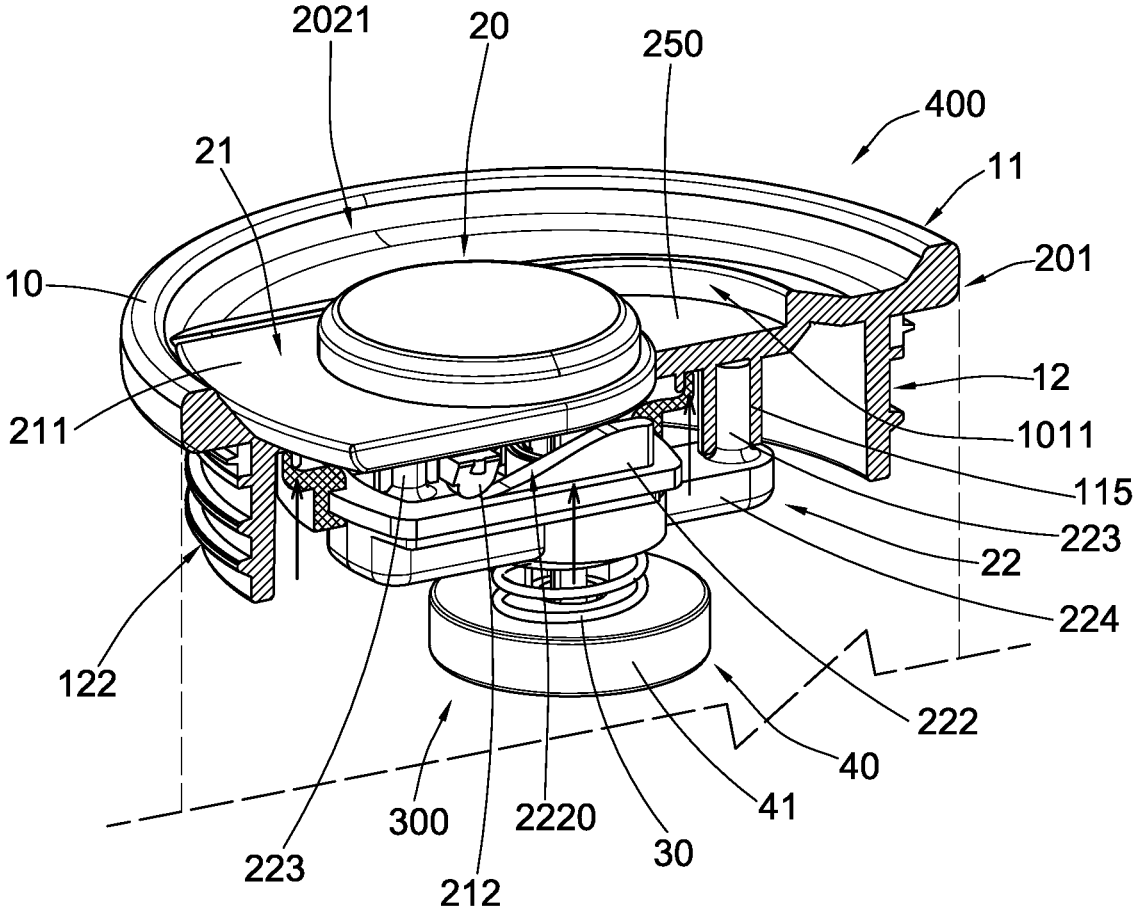
FIG. 4A is an exploded perspective view of the lid of the beverage container according to the preferred embodiment of the present invention.
Figure 4B:
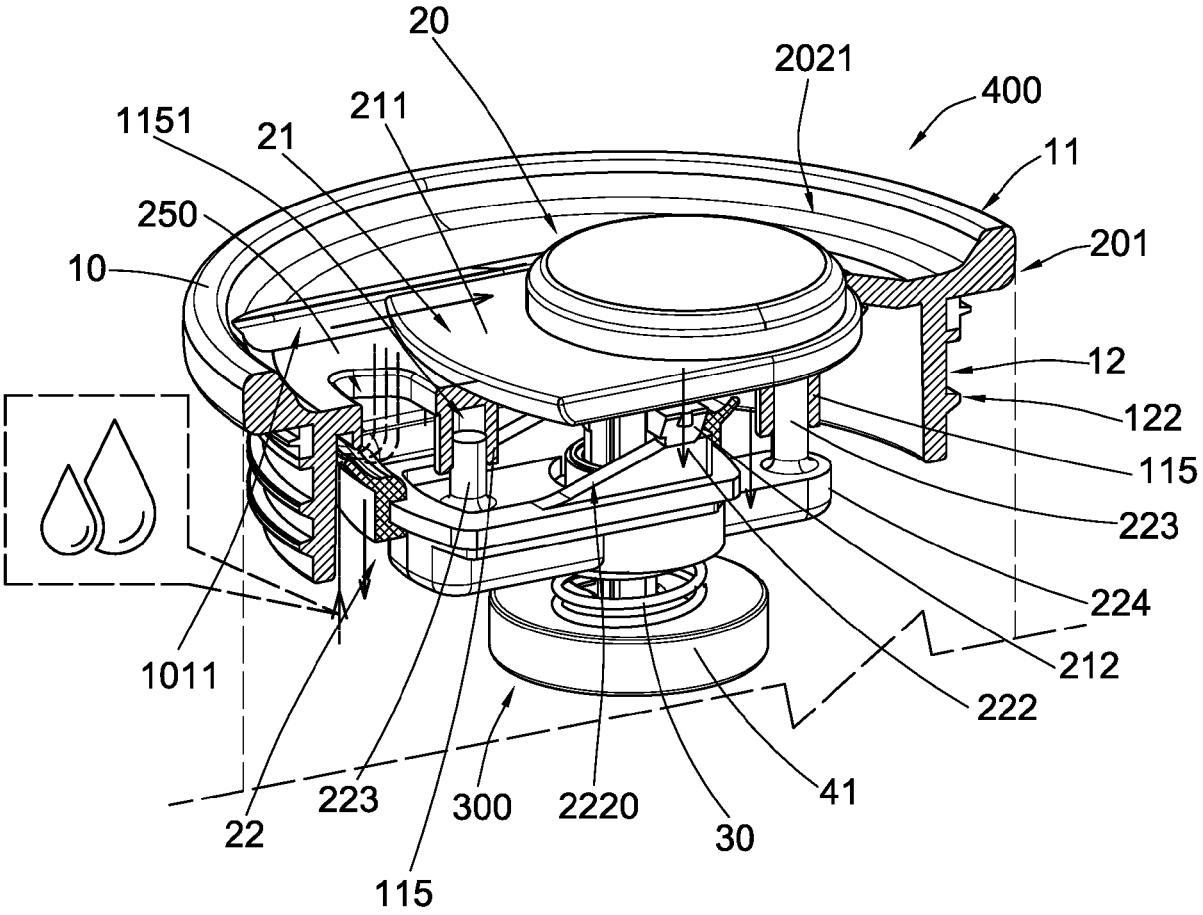
FIG. 4B is an exploded perspective view of the lid of the beverage container according to the preferred embodiment of the present invention.
Figure 5:
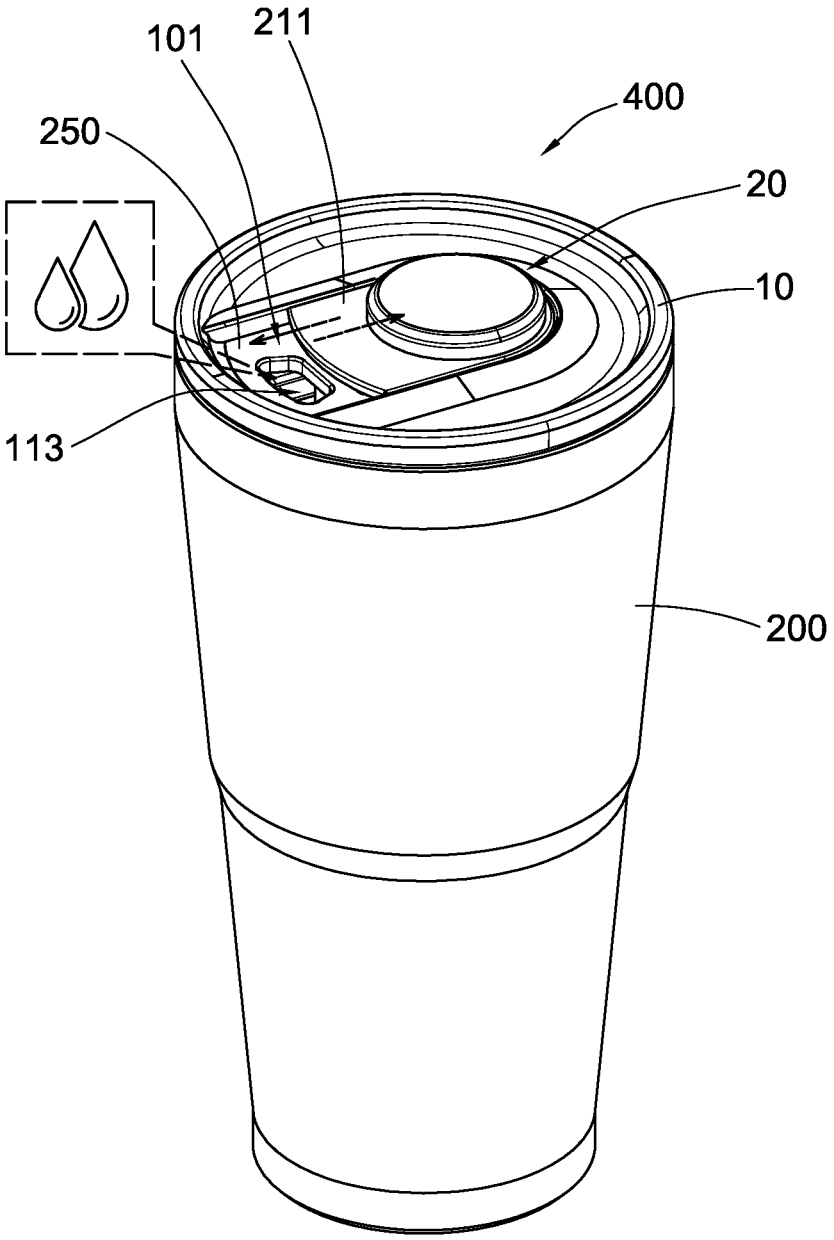
FIG. 5 is a side view of a rotatable sealing arrangement of the lid according to the above preferred embodiment of the present invention, illustrating that a cover assembly is in a closed position.
Figure 6:
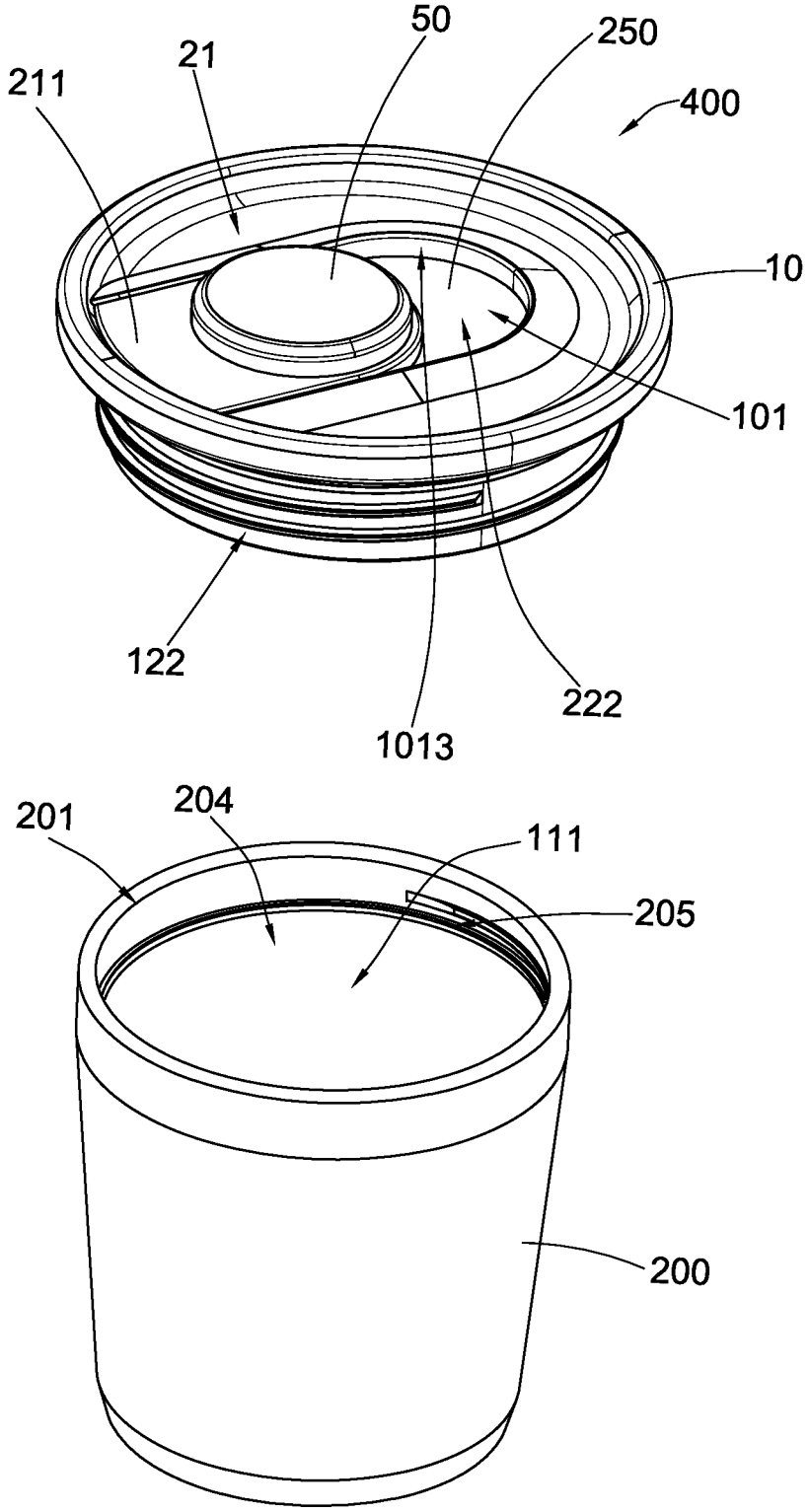
FIG. 6 is an exploded perspective view of the beverage container according to the preferred embodiment of the present invention.

The lid 400 may mainly be configured from plastic material. The lid body 10 may have a cross sectional shape which is corresponding to that of the container body 200. As shown in FIG. 4A to FIG. 4B of the drawings, the lid body 10 may have a rim portion 201, an upper tubular portion 11 upwardly extended from the rim portion 201, and a lower tubular portion 12 downwardly extended from the rim portion 201. In this preferred embodiment, the lid body 10 may have a circular cross-sectional shape which allows tight engagement with the container body 200. Other cross-sectional shapes for both the container body 200 and the lid body 10 are also possible.

Referring to FIG. 2A, FIG. 2B, FIG. 4A and FIG. 4B of the drawings, each of the upper tubular portion 11 and the lower tubular portion 12 may define an upper cavity 2021 and a lower cavity 2031 respectively, wherein the support panel 250 may be formed in the upper cavity 2021 adjoining the rim portion 201. In other words, the upper tubular portion 11 constitutes a circumferential boundary of the upper cavity 2021, and the lower tubular portion 12 constitute a circumferential boundary of the lower cavity 2031.

Figure 2A:
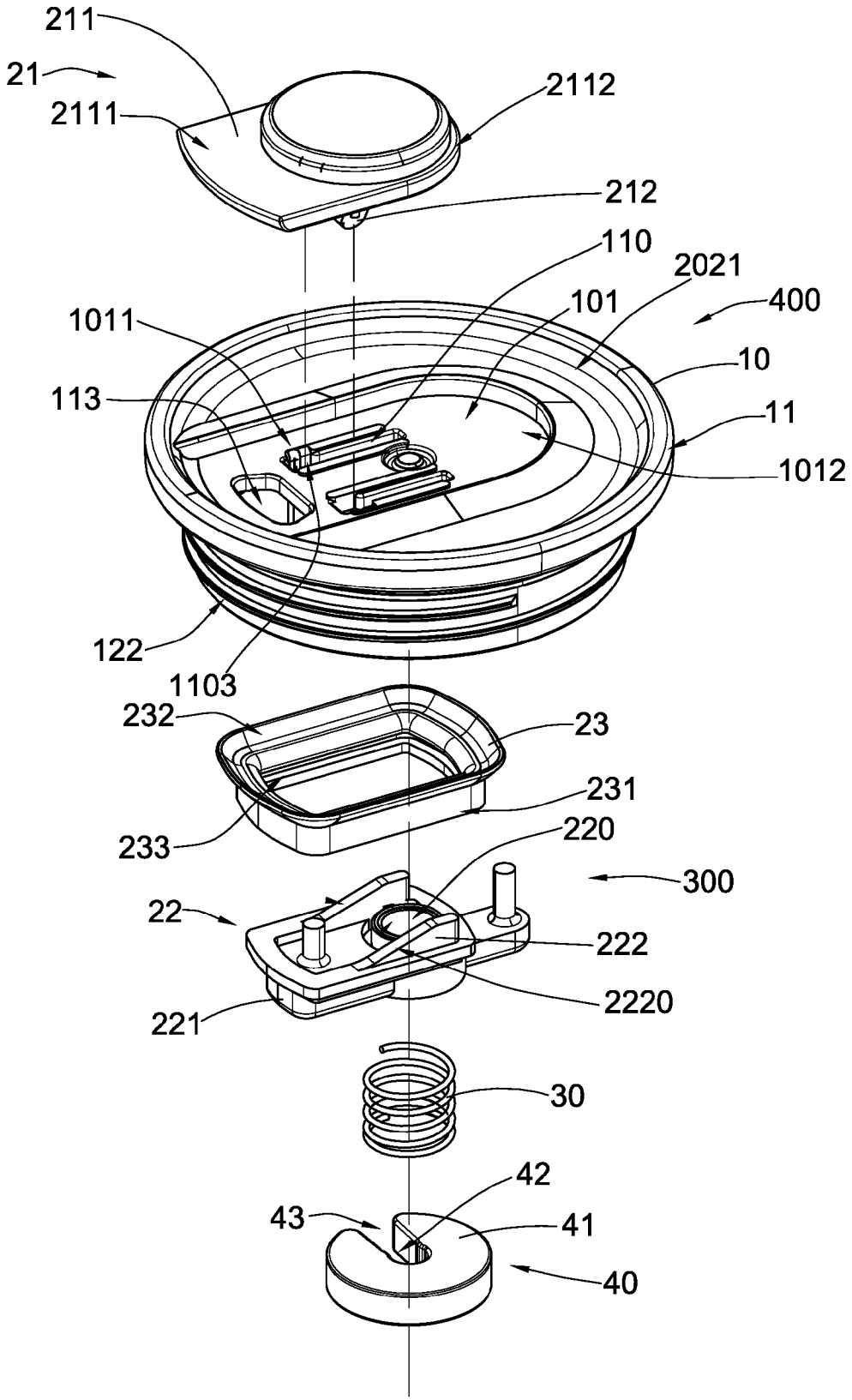
FIG. 2A is a top exploded perspective view of the lid of the beverage container according to a preferred embodiment of the present invention.
Figure 2B:
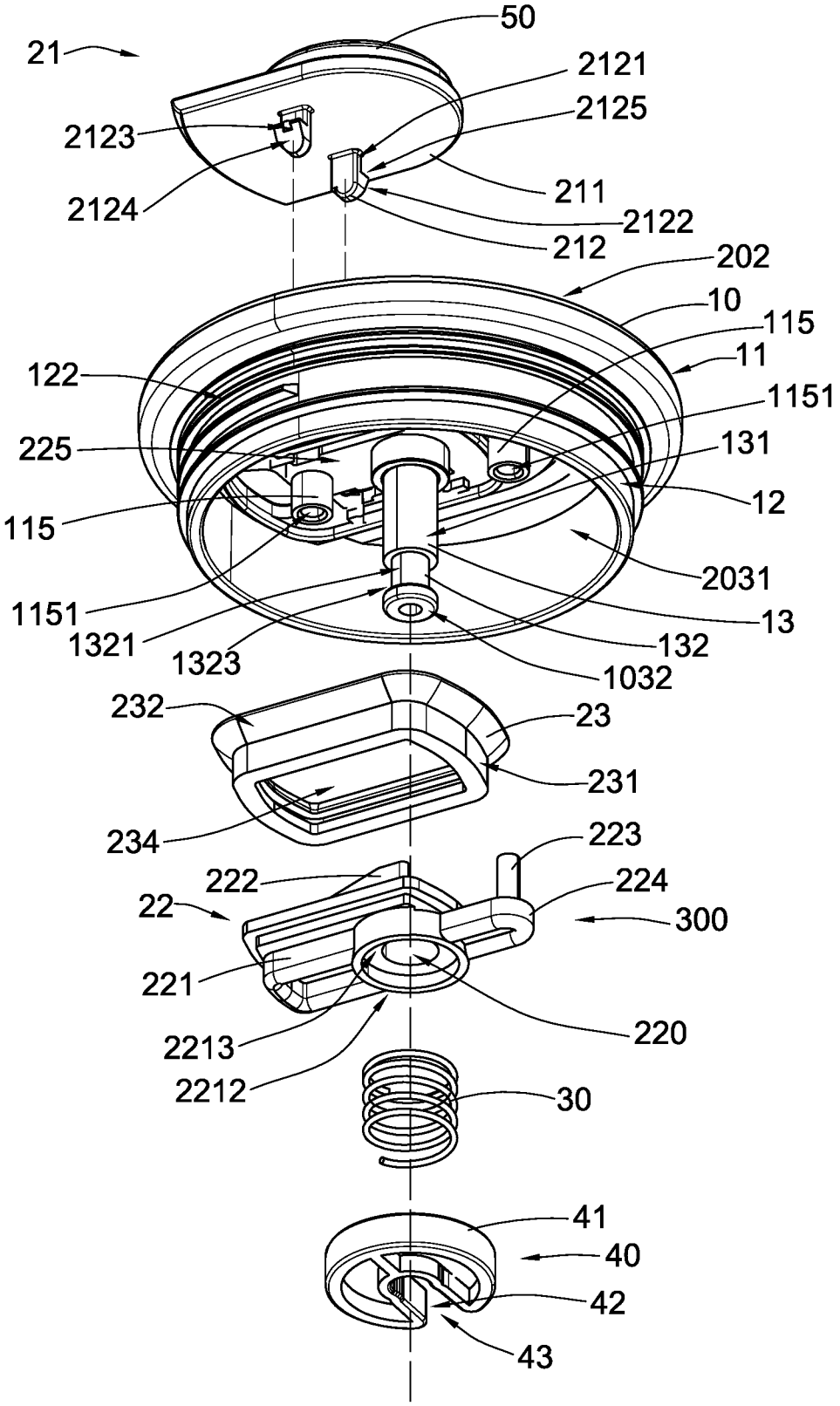
FIG. 2B is a bottom exploded perspective view of the lid of the beverage container according to a preferred embodiment of the present invention.
Figure 3:
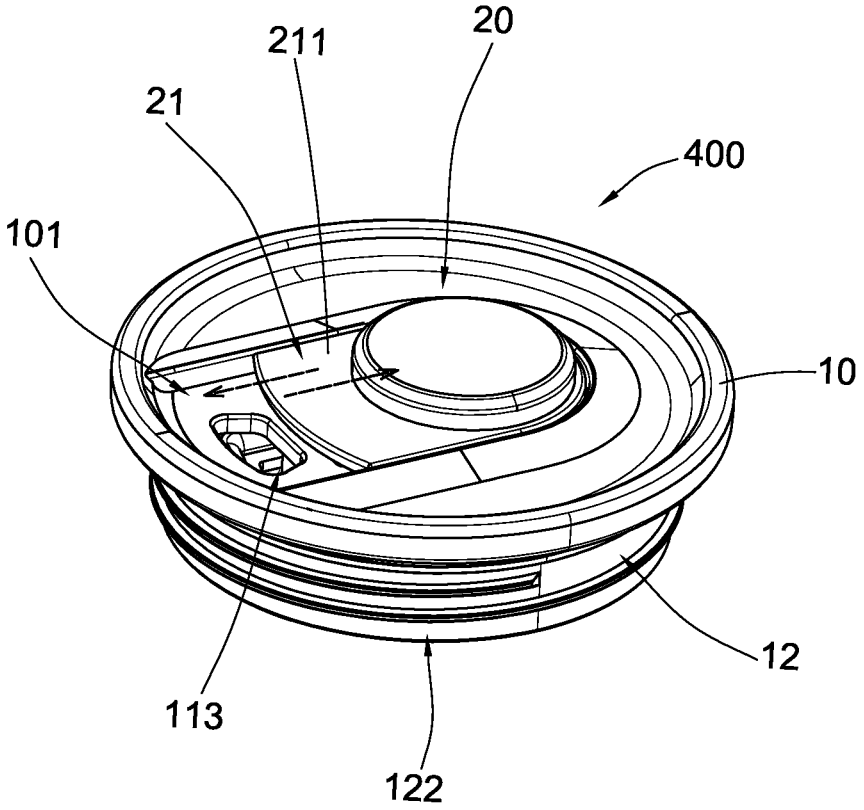
FIG. 3 is an exploded perspective view of the beverage container according to the preferred embodiment of the present invention.

Referring to FIG. 2A and FIG. 2B of the drawings, the lid body 10 may further have a securing groove 101 formed thereon, wherein the support panel 250 may form as a bottom boundary of the securing groove 101. Moreover, the access opening 113 may be formed as a through hole on the support panel 250 in the securing groove 101. As shown in FIG. 1A and FIG. 2A of the drawings, the securing grooves 101 may be bounded by a sidewall 1013 and the sidewall 1013 may have a curved contour and form a side boundary of the securing groove 101. Note also that the actuation slots 110 may also be formed on the support panel 250 at positions adjacent to the access opening 113.

The lid body 10 may further have a plurality of first engaging threads 122 formed on an external surface of the lower tubular portion 12 while the container body 200 may have a plurality of second engaging threads 205 formed on an inner surrounding surface 204 surrounding the container cavity 111 near the top opening 201, wherein the first engaging threads 122 and the second engaging threads 205 may be positioned to correspond to each other so that the lid body 10 may engage with the container body 200 through detachable engagement between the first engaging threads 122 and the second engaging threads 205. As shown in FIG. 4A of the drawings, an external diameter of the upper tubular portion 11 may be larger than an internal diameter of the container cavity 111 so that when the lid body 10 is detachably attached on the container body 200, the top opening 201 may be fully covered by the lid body 10.

As shown in FIG. 2B of the drawings, the main shaft 13 may have an upper shaft portion 131 and a lower shaft portion 132 extending from the upper shaft portion 131. The main shaft 13 as a whole may be arranged to be mounted in the lower cavity 2031 of the lower tubular portion 12 by extending from a bottom surface 225 of the support panel 250.

According to the preferred embodiment of the present invention, each of the upper shaft portion 131 and the lower shaft portion 132 may have a circular cross-sectional shape. One skilled in the art may appreciate that other cross-sectional shapes are also possible.

On the other hand, the lower shaft portion 132 may be divided into a contracted section 1321 and a lower end section 1322, wherein a diameter of the contracted section 1321 may be smaller than that of the lower end section 1322 to form a circumferential slot 1323 at the lower shaft portion 132 due to change in diameter between the contracted section 1321 and the lower end section 1322.

The first cover 211 may be movably positioned on the support panel 250 of the lid body 10. In the preferred embodiment of the present invention, the first cover 211 may be positioned on a top surface 222 of the support panel 250 in a movable manner. A movement of the first cover 211 may be limited by the securing groove 101.

Figure 1B:
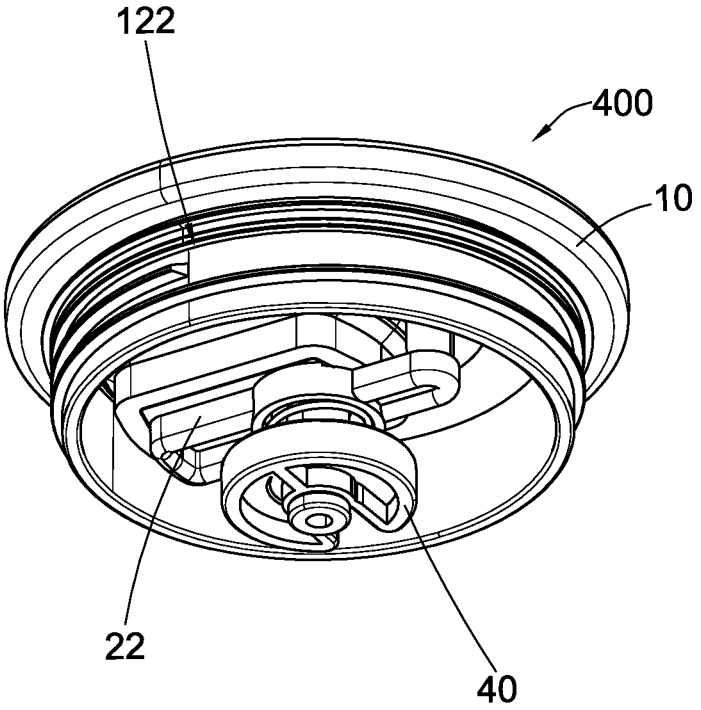
FIG. 1B is a bottom perspective view of the lid of the beverage container according to a preferred embodiment of the present invention.

Referring to FIG. 1 and FIG. 2A of the drawings, the securing groove 101 may have an elongated portion 1011 and an end portion 1012, wherein the access opening 113 and the actuation slots 110 may be formed in the elongated portion 1011. The end portion 1012 may have a curved or a semi-circular cross sectional shaped when viewed from the top.

On the other hand, the first cover 211 may have a main cover portion 2111 and a pusher end portion 2112, wherein the main cover portion 2111 may be arranged to dispose on the support panel 250 in the elongated portion 1011 of the securing groove 101 for covering the access opening 113 and the actuation slots 110. The main cover portion 2111 may take a variety of forms, an exemplary configuration may be a panel having an external shape corresponding to that of a cross sectional shape of the securing groove 101. The pusher end portion 2112 may extend from the main cover portion 2111 and receive in the elongated portion 1011 of the securing groove 101 when the cover assembly 21 is in the closed position. Note that an external contour or shape of the pusher end portion 2112 may correspond to that of the end portion 1012 of the securing groove 101 so that the pusher end portion 2112 may be slid to receive in the end portion 1012 of the securing groove 101 when the cover assembly 21 is in the opened position.

Figure 7:
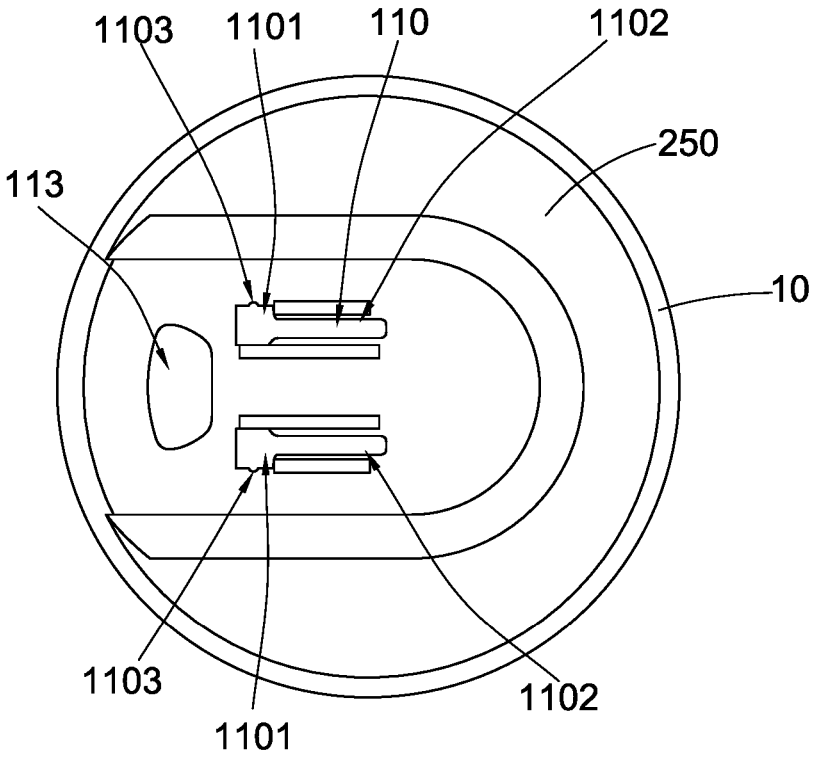
FIG. 7 is a top view of a lid body of the beverage container according to the preferred embodiment of the present invention.

As shown in FIG. 7 of the drawings, each of the actuation slots 110 may have a wider portion 1101 and a narrower portion 1102 in which a width of the wider portion 1101 may be larger than that of the corresponding narrower portion 1102. Each of the wider portion 1101 and the narrower portion 1102 may form a rectangular cross-sectional shape when viewed from the top. However, other cross-sectional shapes are also possible. As an exemplary configuration, the wider portions 1101 may be positioned closer to the access opening 113 while the narrower portions 1102 may extend from the wider portions 1101 in the direction away from the access opening 113.

Furthermore, the lid body 10 may further have a plurality of (but at least one) positioning recesses 1103 indently formed on outer sidewalls 1104 of the actuation slots 110 respectively for engaging with the connector legs 212 of the cover assembly 21 respectively. Referring to FIG. 2A and FIG. 7 of the drawings, the positioning recesses 1103 may be formed on the outer sidewalls 1104 of the actuation slots 110 in the wider portions 1101 respectively.

Moreover, the lid body 10 may further comprise a plurality of (but at least one) first restraining members 115 downwardly extended from the support panel 250 for restricting a movement of the sealing piece 22 (described below). Each of the first restraining members 115 may take a wide variety of forms. An exemplary configuration in this preferred embodiment is that each of the first restraining members 115 is an elongated and tubular shaft having a central slot 1151.

As shown in FIG. 2A and FIG. 2B of the drawings, each of the connector legs 212 may downwardly extend from the first cover 211. The connector legs 212 may be positioned to correspond to the actuation slots 110 respectively, so that the connector legs 212 may slidably move along the actuation slots 110 respectively. Each of the connector legs 212 may have a thinner portion 2121, a thicker portion 2122 extended from the thinner portion 2121, and a protrusion 2123 sidewardly extended from the thicker portion 2122. According to the preferred embodiment of the present invention, each of the thinner portions 2121 may extend from the first cover 211 while each of the thicker portions 2122 may downwardly extend from the corresponding thinner portion 2121 along a longitudinal direction thereof. Moreover, the thinner portion 2121 has a thickness which is smaller than that of the thicker portion 2122, while a thickness of the thicker portion 2122 may gradually decrease from top to bottom so as to form a generally tapered shape. As an exemplary configuration, each of the connector legs 212 may define a first inclined surface 2124 due to the gradual change in thickness of the thicker portion 2122. This gradual change in thickness may also define a connector shoulder 2125 which is a surface transversely extending from the thinner portion 2121 to the corresponding thicker portion 2122.

The connector legs 212 may be slidably mounted in the actuation slots 110 respectively in such a manner that the thicker portions 2122 may be arranged to penetrate through the wider portions 1101 of the actuation slots 110 respectively. The thinner portions 2121 of the connector legs 212 may then be allowed to slide along the narrower portions 1102 of the actuation slots 110 respectively so as to facilitate sliding movement of the connector legs 212 along the actuation slots 110.

In this preferred embodiment of the preferred embodiment, the connector legs 212 may be configured from elastic material such as plastic so that the protrusions 2123 of the connector legs 212 may be arranged to engage with the positioning recesses 1103 formed on the actuation slots 110 respectively when the cover assembly 21 is in the closed position. The engagement between the protrusion 2123 and the positioning recesses 1103 may be retained by the inherent elastic force of the connector legs 212. This elastic force may be overcome by manual force which tend to push the cover assembly 21 from the closed position toward the opened position. At that point, the protrusions 2123 may be disengaged from the positioning recesses 1103 respectively.

From the forgoing descriptions, it can be shown that first cover 211 may be arranged to cover the access opening 113 when the cover assembly 21 is in the closed position. On the other hand, the first cover 211 may be slid to expose the access opening 113 to ambient environment when the cover assembly 21 is in the opened position. Thus, the first cover 211 may seal or cover the access opening 113 from a top side of the support panel 250 (i.e. from a top side of the access opening 113). The first cover 211 may further comprise a top cover 50 for allowing a user to conveniently and manually push the first cover through pushing the top cover 50.

The sealing piece 22 may be mounted underneath the support panel 250 to provide sealing to the container cavity 111 from underneath the support panel 250. The sealing piece 22 may further comprise an auxiliary cover 224 sidewardly extended from the second cover 221. In this preferred embodiment of the present invention, the second cover 221 and the auxiliary cover 224 may form an integral structure as a one-piece body.

The sealing piece 22 may further comprise a plurality of (but at least one) traveling members 222 upwardly extended from the second cover 221 to operatively engage with the connector legs 212 respectively. Each of the traveling members 222 may be configured as a panel-like structure having a second inclined surface 2220. As shown in FIG. 2A of the drawings, each of the traveling members 222 may form a substantially triangular cross-sectional shape in which the second inclined surface 2220 may constitute the longest side of the traveling member 222.

As shown in FIG. 4A and FIG. 4B of the drawings, the traveling members 222 may be positioned corresponding to the connector legs 212 respectively in such a manner that the connector legs 212 may travel along the second inclined surface 2220 of the traveling members 222 respectively. According to the preferred embodiment of the present invention, when the cover assembly 21 is in the closed position, the connector legs 212 may be positioned and rest on the second inclined surfaces 2220 at lower sides of the traveling members 222 respectively (see FIG. 4A). When the cover assembly 21 is being moved from the closed position to the opened position, the first cover 211 is being slid so as to drive the connector legs 212 to travel along the second inclined surfaces 2220 respectively. At the same time, the connector legs 212 may also move along the actuation slots 110 respectively from the wider portions 1101 to the narrower portions 1102. When the cover assembly 21 is in the opened position, the connector legs 212 may move from the lower sides of the traveling members 222 toward the higher sides of the traveling members 222 respectively (FIG. 4B).

It is worth mentioning that since the support panel 250 restricts an upward movement of the connector legs 212, when the connector legs 212 travel along the traveling members 222, the sealing piece 22 may be forced to move downwardly with respect to the main shaft 13.

Moreover, the sealing piece 22 may further comprise a plurality of (but at least one) second restraining members 223 extended from the second cover 221 and the auxiliary cover 224 respectively, wherein the second restraining members 223 may be positioned corresponding to the first restraining members 115 so that when the cover assembly 21 is in the closed position, the first restraining members 115 may be coupled to the second restraining members 223 respectively for restraining a pivotal movement of the cover assembly 21 with respect to the lid body 10.

According to the preferred embodiment of the present invention, the second restraining members 223 may be configured as shafts extending from the second cover 221 and the auxiliary cover 224 respectively. The second restraining members 223 may be inserted in the central slots 1151 of the first restraining members 115 respectively when the cover assembly 21 is in the closed position. It is worth mentioning that the first restraining members 115 and the second restraining members 223 may be interchangeably positioned on the first cover 211, the second cover 221 and the auxiliary cover 224.

Referring to FIG. 2B of the drawings, the sealing piece 22 may further comprise a sealing ring 23 connected to at least one of the second cover 221 and the auxiliary cover 224 for preventing liquid from reaching the actuation slots 110 and the access opening 113. Specifically, the sealing ring 23 may have an upper portion 232 and a lower portion 231. In this particular embodiment, the sealing ring 23 may be circumferentially mounted along a side edge of the second cover 221. The upper portion 232 may circumferentially, inclinedly and outwardly extend from the lower portion 231, and may be arranged to contact with the bottom surface 225 of the support panel 250.

The sealing ring 23 may be made of elastic material such as rubber material so that it may deform when subject to external force, and may restore to its original shape when such external force is removed. The sealing ring 23 may be configured as having a quadrilateral cross-sectional shape with a central opening 234 formed within the quadrilateral.

Thus, the second cover 221 may be configured to have a quadrilateral shape wherein the traveling members 222 and the second restraining members 223 are extended from a top side of the second cover 221. The through hole 220 may be formed in the second cover 221. As shown in FIG. 2A of the drawings, the sealing ring 23 may further have a mounting groove 233 indently formed on an inner surface of the lower portion 231, wherein a side edge portion 2211 of the second cover 221 may be mounted in the mounting groove 233.

Accordingly, the lid body 10 may further comprise a boundary wall 28 downwardly extended from the bottom surface 225 of the support panel 250, wherein the upper portion 232 of the sealing ring 23 may be fittedly engage with the boundary wall 28 so as to seal the gap between the support panel 250 and the sealing ring 23.

The push sealing arrangement 300 may further comprise a resilient element 30 and an end stopper 40 mounted on the main shaft 13 for providing an upward urging force toward the second cover 221 so as to push the sealing piece 22 toward the support panel 250. As an example, the resilient element 30 may be configured as a compression spring and may be mounted on the main shaft 13. On the other hand, the second cover 221 may further have an accommodating cavity 2212 indently formed at a bottom side of the second cover 221, wherein the resilient element 30 may partially receive in the accommodating cavity 2212 and bias against an upper boundary surface 2213 thereof. The resilient element 30 may bias against the upper boundary surface 2213 when it is mounted on the main shaft 13. Thus, the sealing piece 22 may be subject to an upward urging force so that the sealing piece 22 and the sealing ring 23 may bias against the support panel 250 when the cover assembly 21 is in the closed position.

On the other hand, the end stopper 40 may be mounted on the lower shaft portion 132 of the main shaft 13. As shown in FIG. 2B of the drawings, the end stopper 40 may comprise a stopper body 41 having a stopper slot 42 formed on the stopper body 41. The stopper slot 42 may have an elongated structure and extend from a peripheral edge of the stopper body 41 toward a center thereof. As a result, the stopper body 41 may have an opening 43 as the opening of the stopper slot 42. As will be described below, the end stopper 40 may be arranged to couple to the main shaft 13. Thus, a width of the stopper slot 42 may be larger than a diameter of the contracted section 1321 of the lower shaft portion 132 but smaller than a diameter of the lower end section 1322.

As shown in FIG. 2A, FIG. 2B, FIG. 4A and FIG. 4B of the drawings, the end stopper 40 may be coupled to the lower shaft portion 132 of the main shaft 13 in such a manner that the contracted section 1321 of the lower shaft portion 132 may be slidably inserted into the stopper slot 42 via the opening 43. Moreover, the resilient element 30 may be mounted between the end stopper 40 and the second cover 221. Once the contracted section 1321 of the lower shaft portion 132 has been inserted into the stopper slot 42, the end stopper 40 may provide a base for the resilient element 30 to exert an upward urging force toward the second cover 221. In other words, the resilient element 30 may be trapped between the end stopper 40 and the second cover 221. For example, the resilient element 30 may be a compression spring such that when the end stopper 40 is coupled to the main shaft 13, the resilient element 30 is slightly compressed and exert an upward urging force toward the sealing piece 22 so as to force the sealing piece 22 to seal the access opening 113 from underneath the support panel 250.

The operation of the present invention may be described follows: when the cover assembly 21 is in the locked position, the first cover 211 may slid such that the main cover portion 2111 completely covers the access opening 113 from the top of the support panel 250. At the same time, the sealing piece 22 may be pushed by the resilient element 39 so that the second cover 221 and the auxiliary cover 224 may be pushed to cover the access opening 113 from underneath the support panel 250. This creates a double sealing effect (one from above the support panel 250 and one from underneath the support panel 250) to seal the access opening 113. The result is that when the cover assembly 21 is in the locked position, liquid in the container cavity 111 is prevented from spilling out therefrom through the access opening 113, even when the beverage container is flipped sideway or turned upside down. The sealing ring 23 attaching to the second cover 221 may provide enhanced sealing effect for preventing liquid from spilling out from the access opening 113 through the gap between the support panel 250 and the sealing ring 23.

When a user wishes to drink the liquid stored in the container cavity 111, he or she may slide the first cover 211 and the connector legs 212 may also be driven to slide along the securing groove 101. The manual sliding force exerted to the first cover 211 may drive the connector legs 212 to move along the traveling members 222. This has the effect of pushing the second cover 221 to move downwardly with respect to the main shaft 13 because the first cover 211 and the connector legs 212 are restrained from moving vertically with respect to the lid body 10. At this time, the protrusions 2123 of the connector legs 212 may engage with the positioning recesses 1103 respectively. The second cover 221 will then compress the resilient element 30 and expose the access opening 113 to the container cavity 111 of the container body 200. The user may then be able to drink the liquid from the container cavity 111.

When the user finishes drinking the liquid, he or she may simply exert a slight sliding force to the first cover 211 in the direction which tend to close the access opening 113. This slight force disengages the protrusions 2123 of the connector legs 212 from the positioning recesses 1103 respectively. The upward pushing force exerted by the retention element 39 may cause the connector legs 212 to travel back to the original position along the traveling members 222 and this cause the entire sealing piece 22 to move upwardly along the main shaft 13 and back to its original position. At the same time, since the connector legs 212 are driven to move back down along traveling members 222 respectively, the first cover 211 may be forced to slide back to the original position so as to close the access opening 113. At this time, the cover assembly 21 may be restored to the closed position.

The present invention, while illustrated and described in terms of a preferred embodiment and several alternatives, is not limited to the particular description contained in this specification. Additional alternative or equivalent components could also be used to practice the present invention.

What is claimed is:

1. A beverage container, comprising:

a container body having a container cavity; and a lid, which comprises a lid body detachably attached on said container body to selectively enclose said container cavity, said lid body having a support panel, an actuation slot, and an access opening formed on said support panel; and a push sealing arrangement, which comprises:

a cover assembly which comprises a first cover movably mounted on said support panel, and a connector leg downwardly extended from the first cover to engage with said actuation slot;

a main shaft downwardly extended from said support panel; and a sealing piece movably coupled to said main shaft, said sealing piece comprising a coupler ring having a through hole formed therein, a second cover sidewardly extended from said coupler ring to position underneath said first cover and said access opening, said cover assembly being slid on said lid body to operatively move between an opened position and a closed position, wherein in said closed position, said cover assembly is slid to drive said first cover to cover on top of said access opening, while said second cover of said sealing piece is driven to move upwardly with respect to said main shaft for blocking a bottom side of said access opening so as to prevent liquid from said container cavity to spill out therefrom, wherein in said opened position, said first cover is slid to expose said access opening to ambient environment, while said second cover is driven to move downwardly with respect to said main shaft so as to allow liquid to flow out of said container cavity through said access opening.

2. The beverage container, as recited in claim 1, wherein said main shaft has an upper shaft portion and a lower shaft portion extending from said upper shaft portion, said lower shaft portion being divided into a contracted section and a lower end section, wherein a diameter of said contracted section is smaller than that of said lower end section to form a circumferential slot at said lower shaft portion.

3. The beverage container, as recited in claim 2, wherein said actuation slot has a wider portion and a narrower portion in which a width of said wider portion is larger than that of said narrower portion, said wider portion being positioned closer to said access opening than that of said narrower portion, said narrower portion extending from said wider portion in a direction away from said access opening.

4. The beverage container, as recited in claim 3, wherein said lid body further has a positioning recess indently formed on an outer sidewall of said actuation slot in said wider portion for engaging with said connector legs of said cover assembly.

5. The beverage container, as recited in claim 4, wherein said lid body further comprises a first restraining members downwardly extended from said support panel for restricting a movement of said sealing piece, said sealing piece further comprising a second restraining member, said second restraining member being positioned corresponding to said first restraining member so that when said cover assembly is in said closed position, said first restraining member is arranged to be coupled to said second restraining member.

6. The beverage container, as recited in claim 5, wherein said connector leg downwardly extends from said first cover and positioned to correspond to said actuation slot, said connector leg having a thinner portion, a thicker portion extended from said thinner portion, and a protrusion sidewardly extended from said thicker portion for selectively engaging with said positioning recess, said thinner portion having a thickness smaller than that of said thicker portion, while a thickness of said thicker portion gradually decreasing from top to bottom thereof so as to form a generally tapered shape, said thinner portion being arranged to penetrate through said wider portion of said actuation slot for slidably connecting said connecting leg to said actuation slot.

7. The beverage container, as recited in claim 6, wherein said sealing piece further comprises a traveling member upwardly extended from said second cover to operatively engage with said connector leg, said traveling member has a second inclined surface positioned corresponding to said connector legs in such a manner that said connector leg is capable of traveling along said second inclined surface, so that when said cover assembly is in said closed position, said connector leg is positioned and rest on said second inclined surface at lower side of said traveling member, wherein when said cover assembly is moved from said closed position to said opened position, said connector leg is driven to travel along said second inclined surface.

8. The beverage container, as recited in claim 7, wherein said sealing piece further comprises a sealing ring connected to said second cover for preventing liquid from reaching said actuation slots and said access opening, said sealing ring having an upper portion and a lower portion, said upper portion circumferentially, inclinedly and outwardly extending from said lower portion, and being arranged to contact with a bottom surface of said support panel.

9. The beverage container, as recited in claim 8, wherein said push sealing arrangement further comprises a resilient element and an end stopper mounted on said lower shaft portion of said main shaft for providing an upward urging force toward said second cover so as to push said sealing piece toward said support panel.

10. The beverage container, as recited in claim 9, wherein said end stopper comprises a stopper body having a stopper slot formed on said stopper body, said stopper slot having an elongated structure and extending from a peripheral edge of said stopper body toward a center thereof, a width of said stopper slot being larger than a diameter of said contracted section of said lower shaft portion but smaller than a diameter of said lower end section.

11. A lid for a container body having a container cavity, comprising:

a lid body detachably attached on said container body to selectively enclose said container cavity, said lid body having a support panel, an actuation slot, and an access opening formed on said support panel; and a push sealing arrangement, which comprises:

a cover assembly which comprises a first cover movably mounted on said support panel, and a connector leg downwardly extended from the first cover to engage with said actuation slot;

a main shaft downwardly extended from said support panel; and a sealing piece movably coupled to said main shaft, said sealing piece comprising a coupler ring having a through hole formed therein, a second cover sidewardly extended from said coupler ring to position underneath said first cover and said access opening, said cover assembly being slid on said lid body to operatively move between an opened position and a closed position, wherein in said closed position, said cover assembly is slid to drive said first cover to cover on top of said access opening, while said second cover of said sealing piece is driven to move upwardly with respect to said main shaft for blocking a bottom side of said access opening so as to prevent liquid from said container cavity to spill out therefrom, wherein in said opened position, said first cover is slid to expose said access opening to ambient environment, while said second cover is driven to move downwardly with respect to said main shaft so as to allow liquid to flow out of said container cavity through said access opening.

12. The lid, as recited in claim 11, wherein said main shaft has an upper shaft portion and a lower shaft portion extending from said upper shaft portion, said lower shaft portion being divided into a contracted section and a lower end section, wherein a diameter of said contracted section is smaller than that of said lower end section to form a circumferential slot at said lower shaft portion.

13. The lid, as recited in claim 12, wherein said actuation slot has a wider portion and a narrower portion in which a width of said wider portion is larger than that of said narrower portion, said wider portion being positioned closer to said access opening than that of said narrower portion, said narrower portion extending from said wider portion in a direction away from said access opening.

14. The lid, as recited in claim 13, wherein said lid body further has a positioning recess indently formed on an outer sidewall of said actuation slot in said wider portion for engaging with said connector legs of said cover assembly.

15. The lid, as recited in claim 14, wherein said lid body further comprises a first restraining members downwardly extended from said support panel for restricting a movement of said sealing piece, said sealing piece further comprising a second restraining member, said second restraining member being positioned corresponding to said first restraining member so that when said cover assembly is in said closed position, said first restraining member is arranged to be coupled to said second restraining member.

16. The lid, as recited in claim 15, wherein said connector leg downwardly extends from said first cover and positioned to correspond to said actuation slot, said connector leg having a thinner portion, a thicker portion extended from said thinner portion, and a protrusion sidewardly extended from said thicker portion for selectively engaging with said positioning recess, said thinner portion having a thickness smaller than that of said thicker portion, while a thickness of said thicker portion gradually decreasing from top to bottom thereof so as to form a generally tapered shape, said thinner portion being arranged to penetrate through said wider portion of said actuation slot for slidably connecting said connecting leg to said actuation slot.

17. The lid, as recited in claim 16, wherein said sealing piece further comprises a traveling member upwardly extended from said second cover to operatively engage with said connector leg, said traveling member has a second inclined surface positioned corresponding to said connector legs in such a manner that said connector leg is capable of traveling along said second inclined surface, so that when said cover assembly is in said closed position, said connector leg is positioned and rest on said second inclined surface at lower side of said traveling member, wherein when said cover assembly is moved from said closed position to said opened position, said connector leg is driven to travel along said second inclined surface.

18. The lid, as recited in claim 17, wherein said sealing piece further comprises a sealing ring connected to said second cover for preventing liquid from reaching said actuation slots and said access opening, said sealing ring having an upper portion and a lower portion, said upper portion circumferentially, inclinedly and outwardly extending from said lower portion, and being arranged to contact with a bottom surface of said support panel.

19. The lid, as recited in claim 18, wherein said push sealing arrangement further comprises a resilient element and an end stopper mounted on said lower shaft portion of said main shaft for providing an upward urging force toward said second cover so as to push said sealing piece toward said support panel.

20. The lid, as recited in claim 19, wherein said end stopper comprises a stopper body having a stopper slot formed on said stopper body, said stopper slot having an elongated structure and extending from a peripheral edge of said stopper body toward a center thereof, a width of said stopper slot being larger than a diameter of said contracted section of said lower shaft portion but smaller than a diameter of said lower end section.

* * * * *